United States Patent [19]

Shemitz

[11] 4,298,916

[45] Nov. 3, 1981

[54] LIGHTING SYSTEM WITH BAFFLE

[76] Inventor: Sylvan R. Shemitz, Sunbrook Rd., Woodbridge, Conn.

[21] Appl. No.: 819,067

[22] Filed: Jul. 26, 1977

Related U.S. Application Data

[63] Continuation-in-part of Ser. No. 783,676, Apr. 1, 1977, Pat. No. 4,173,034.

[51] Int. Cl.[3] ..... F21V 5/02

[52] U.S. Cl. ..... 362/127; 362/19; 362/223; 362/224; 362/330

[58] Field of Search ..... 362/19, 127, 134, 255, 362/260, 335, 223, 224, 349, 351, 33, 97, 330

[56] References Cited

U.S. PATENT DOCUMENTS

| | | | |
|---|---|---|---|
| 3,239,659 | 3/1966 | Makas | 362/19 |
| 3,679,893 | 7/1972 | Shemitz | 362/345 |
| 3,794,830 | 2/1974 | Hitzler | 362/260 |
| 3,876,285 | 4/1975 | Schwarzmüller | 362/19 |
| 4,054,793 | 10/1977 | Shemitz | 362/127 |

*Primary Examiner*—Donald P. Walsh
*Attorney, Agent, or Firm*—DeLio and Montgomery

[57] ABSTRACT

A lighting system wherein a task-oriented light source is supplemented by the provision of a baffle so located in relation to the positions of the source, the task and the observer as to block out or modify, in whole or in part, the light reaching the task at angles such as would produce veiling reflections. The baffle may be plastic or glass with polarizing characteristics and may be flat or curved; it also may be fixed or adjustable.

4 Claims, 5 Drawing Figures

LIGHTING SYSTEM WITH BAFFLE

This application is a continuation-in-part of Serial No. 783,676, filed Apr. 1, 1977 now U.S. Pat. No. 4,173,034.

This invention relates to a lighting system, particularly of the task-oriented type, which includes a screen or baffle so located as to occlude, wholly or partially, the light from the light source which would otherwise strike the task in a position and at an angle such as to produce a veiling reflection at the point of observation.

Light from a source, such as a desk lamp or elongated luminaire, striking a "task" resting horizontally on a desk surface is reflected at an angle corresponding to the angle of incidence. Such reflection, at the eye of an observer, reduces the contrast between light and dark areas of the work (e.g., a white page and dark type printed thereon) and is termed a "veiling reflection".

Efforts to reduce or eliminate veiling reflections have included such expedients as the provision of lenses beneath the light source designed to refract laterally substantial proportions of the light, while the task still receives adequate amounts but of reduced magnitude. While such an arrangement has some merit there remain some veiling reflections in each vertical plane through the task and the eye of the observer whenever said planes also include a portion of the light source.

In applicant's U.S. Pat. No. 3,389,246, June 18, 1968, a combined desk, wall partition and lighting fixture is disclosed, the fixture including fluorescent tubes and upper and lower light control devices, shown as comprising rectangular grille baffles for directing the light vertically upward at the ceiling and downward toward the desk surface. Because of the horizontal areas of the openings in the lower grille, light may be able to reach a task on the desk surface at an angle such as to create veiling reflections into the eyes of the observer, even though all direct glare is eliminated.

In applicant's U.S. Pat. No. 3,679,893, July 25, 1972 (with Benjamin L. Stahlheber) a luminaire is disclosed wherein reflectors of special form distribute the light from an elongated source in a manner such as to illuminate uniformly a defined area. When applied to the lighting of a horizontal task, as on a desk or table, a portion of such uniform illumination may be so oriented as to cause veiling reflections.

It is accordingly an object of the present invention to provide a lighting system which includes an elongated light source and a screen or baffle so located as to prevent light from reaching the task along paths which would create veiling reflections. The position of the observer, whether constant or variable, must be considered as a factor in determining the dimensions of the screen or baffle and the need for adjustability.

It is another object of the invention to provide a screen or baffle assembly adapted for installation in combination with the reflectors of the above-cited patent No. 3,679,893.

It is a further object of the invention to provide a screen or baffle (hereinafter referred to as a "baffle") which occludes only the light which would otherwise cause veiling reflections while permitting full illumination of the task by other light.

It is a still further object of the invention to provide a lighting system wherein the elimination of veiling reflections is effected by means which do not or need not include lenses, refractors or reflecting elements.

It is yet another object of the invention to provide certain improvements in the form, construction and arrangement of the several elements by which the abovenamed and other objects may effectively be attained.

The invention accordingly comprises an artile of manufacture possessing the features, properties, and the relation of elements which will be exemplified in the article hereinafter described, and the scope of the invention will be indicated in the claims.

A practical embodiment of the invention is shown in the accompanying drawing wherein.

Figure 1:
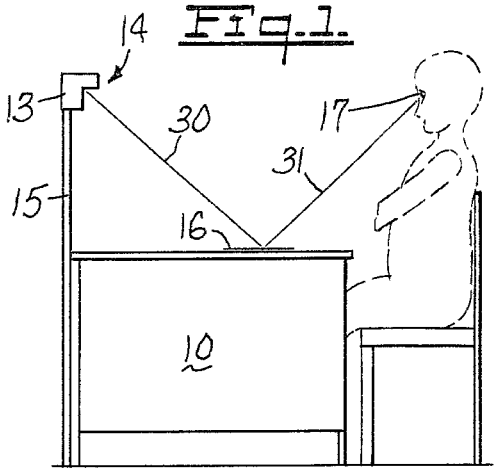
FIG. 1 represents, somewhat diagrammatically, a side elevation of a desk and lighting fixture, with the position of an observer in a normal position being indicated in broken line.
Figure 2:
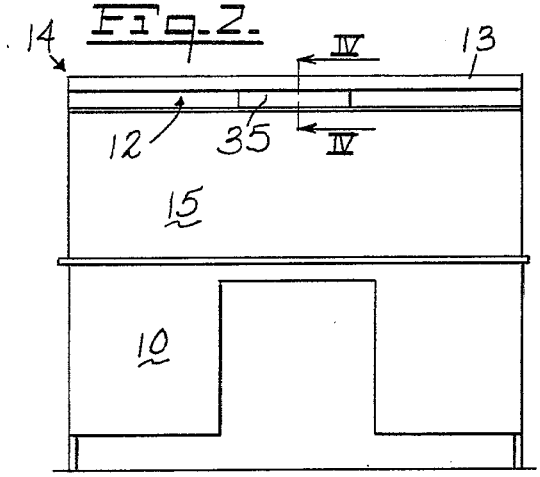
FIG. 2 represents a front view of the desk, lighting fixture and baffle.

Referring to the drawing, and particularly to FIGS. 1 and 2, the elements which are basic to a task lighting system, regardless of the room lighting, if any, include a work surface such as the desk 10, a light source such as the tube 11, usually with a reflector 12 and housing 13 all constituting a luminaire 14 and a support 15 for the luminaire. The support may be a partition, as illustrated, or one or more posts. The task to be illuminated is located on the work surface in the area designated 16 and the point of observation (i.e., the observer's eyes) is assumed to be at 17.

The luminaire shown herein is preferably provided with reflecting surfaces of the type illustrated in FIG. 6 of applicant's Patent No. 3,679,893, cited above, the light source 11 and reflectors 12' and 12'' being enclosed in a housing 13, inverted L-shaped in cross-section, with the space between the bottom edges of the reflectors open for passage of light. The front housing wall 20 has an inwardly turned flange 21 defining, with the bottom edge of reflector 12', a rearwardly open slot 22, and the bottom housing wall 23 has an unwardly turned flange 24 which defines, with the bottom edge of reflector 12', an upwardly open slot 25.

It is evident that light from the source 11, if unimpeded, will follow the path 30 and strike the task area 16, to be reflected at the same angle, on the path 31, toward the point of observation 17, thus creating veiling reflections which may interfere seriously with observation of the task, such as reading a printed text. It is also clear that adequate illumination, without veiling reflections, is most desirable. To achieve this result the luminaire is provided with a baffle 35, preferably adjustably mounted in the enclosure 13, the baffle being located adjacent the portion of the light source from which the light causing veiling reflections originates. Assuming that the observer is located adjacent the middle of the desk with the task directly in front of him, the baffle should be located opposite the middle of the desk in front of the light source and in a position to prevent unmodified light emitted by the part of the source directly in front of the observer from reaching the task.

The baffle 35 is here shown as being in the form of a sheet of plastic polarizing material having a vertical polarizing axis 36, bent in L-form with upwardly and inwardly offset flanges 37, 38 along its front and lower edges, respectively. The bent sheet is so dimensioned that the flanges 37, 38 can be snapped into the slots 22,25, respectively, and its width may suitably be about seventeen inches. The side edges of the baffle are finished and protected by vinyl extrusions 39 which can be cemented in place and easily grasped for moving the baffle, if desired.

Figure 3:
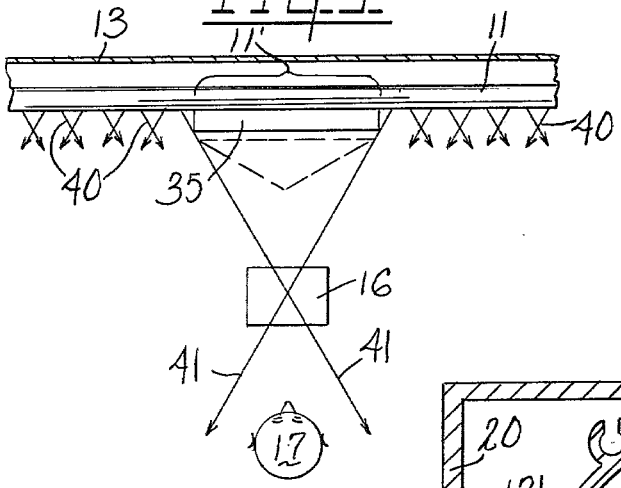
FIG. 3 is a diagrammatic view, from above, showing the relative position of a light tube, baffle, task and observer, with light paths indicated.

With such a baffle installed in the luminaire the distribution of light is as illustrated in FIG. 3 wherein light from the portion 11' of the light source 11 in front of the observer is prevented by the baffle 35 from reaching the task area 16 except as vertically polarized light. The task area is, however, illuminated by light from both end portions of the source, as indicated by the small crossed arrows 40, the light beams which come nearest to causing veiling reflections being indicated by the longer crossed arrows 41. So long as the observer, at 17, maintains a position between the diverging light paths 41, no veiling reflections will be observed. If the observer needs or wishes to move right or left, the baffle can be laterally adjusted by sliding it along the slots 22, 25 in either direction.

The baffle must be large enough to occlude unpolarized light from the lamp and reflector, and it is located immediately in front of the lamp and reflector (between the light source and the visual task).

The material can be glass or, preferably, plastic linear polarizing material, producing vertically polarized light. Vertically polarized light inherently reduces veiling reflections.

Reference herein to an "elongated light source" includes not only such devices as fluorescent tubes but also assemblies wherein light from a shorter bulb is caused to take an effectively elongated form by means of reflecting surfaces and/or refracting lenses. Light from the source must be able to illuminate the task, but at an angle or angles such that veiling reflections are not caused.

Figure 4:
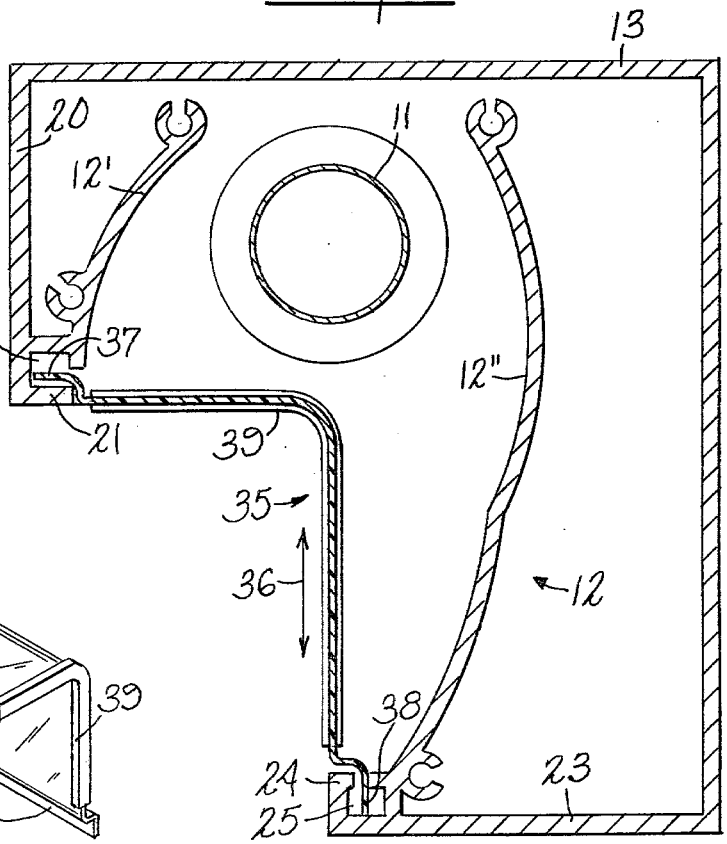
FIG. 4 is a vertical sectional view, on an enlarged scale, on the line IV—IV of FIG. 2.
Figure 5:
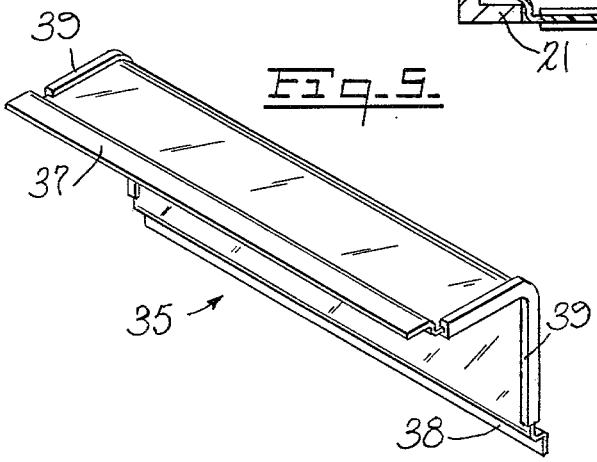
FIG. 5 is an isometric projection of the baffle element.

The luminaire disclosed herein is adapted to receive either a polarizing baffle as described above or, alternatively, a baffle of a solid, opaque or semi-opaque material such as metal, plastic or glass, formed more or less as shown in FIG. 5 and adapted for lateral adjustment in slots such as those shown at 22 and 25 in FIG. 4.

It will thus been seen that the objects set forth above, among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

What I claim is:

1. A task-oriented lighting system for use with a task supported in a substantially horizontal position and adapted to be viewed from a first direction and from an observation point located at elevations between sitting eye height and standing eye height, comprising an elongated light source having its long axis substantially perpendicular to said first direction, said light source being an element of a luminaire which includes a housing and at least one reflector, the housing being provided with at least one slot disposed parallel to the axis of the light source, and the system including a baffle interposed between the light source and the task and extending laterally far enough to intersect most vertical planes passing through the observation point and the task, the baffle being mounted in said slot and laterally adjustable therealong, whereby light from the source which could cause veiling reflections from the task is intercepted.

2. A task-oriented lighting system according to claim 1 wherein the housing is provided with two parallel slots and the baffle has opposite edges, each mounted in a slot.

3. A task-oriented lighting system according to claim 1 wherein the housing has an elongated opening for outward passage of light from the source and the reflector.

4. A task-oriented lighting system according to claim 3 wherein the opening is bordered by at least one longitudinally extending track and an edge of the baffle is engaged in and laterally adjustable along said track.

* * * * *

UNITED STATES PATENT AND TRADEMARK OFFICE

CERTIFICATE OF CORRECTION

PATENT NO. : 4,298,916

DATED : November 3, 1981

INVENTOR(S) : Sylvan R. Shemitz

It is certified that error appears in the above—identified patent and that said Letters Patent is hereby corrected as shown below:

In column 2, line 6, "artile" should read -- article --.

In column 2, line 46, "unwardly" should read -- upwardly --.

In column 4, line 4, "been" should read -- be --.

Signed and Sealed this

Seventh Day of December 1982

[SEAL]

*Attest:*

GERALD J. MOSSINGHOFF

*Attesting Officer*

*Commissioner of Patents and Trademarks*